US011304452B2

(12) United States Patent
Jia

(10) Patent No.: US 11,304,452 B2
(45) Date of Patent: Apr. 19, 2022

(54) DIRECT HEATING VAPORIZER

(71) Applicant: Shenzhen TopGreen Technology Co. Ltd., Guangdong (CN)

(72) Inventor: Guobin Jia, Guangdong (CN)

(73) Assignee: Shenzhen Topgreen Technology Co. Ltd., Guangdong (CN)

( * ) Notice: Subject to any disclaimer, the term of this patent is extended or adjusted under 35 U.S.C. 154(b) by 255 days.

(21) Appl. No.: 16/843,818

(22) Filed: Apr. 8, 2020

(65) Prior Publication Data

US 2021/0315276 A1 Oct. 14, 2021

(51) Int. Cl.
*A24F 40/46* (2020.01)

(52) U.S. Cl.
CPC ..... *A24F 40/46* (2020.01)

(58) Field of Classification Search
CPC ..... A24F 40/20; A24F 40/46
See application file for complete search history.

(56) References Cited

U.S. PATENT DOCUMENTS 5,819,756 A * 10/1998 Mielordt ..... A61M 11/042 131/194
2018/0049472 A1* 2/2018 Mahler ..... A24F 40/42
2020/0146352 A1* 5/2020 Alston ..... A24F 40/10
2021/0084975 A1* 3/2021 Xu ..... A24F 40/46
2021/0315276 A1* 10/2021 Jia ..... A24F 40/46
2021/0378318 A1* 12/2021 Reevell ..... A24F 40/70

* cited by examiner

*Primary Examiner* — James Harvey
(74) *Attorney, Agent, or Firm* — Jen-Feng Lee, Esq.

(57) ABSTRACT

The direct heating vaporizer of present invention primarily consists of a tube, a heating chamber and a material chamber located inside the tube. A filter unit connects the heating chamber and the material chamber; the filter can be replaced. A heating net inside the heating chamber produces heat to heat up the tobacco or other vaping medium directly when activated and controlled by a temperature sensing and control unit. Such direct heating mechanism results in shorter heating time and evenly heating applied to the vaping medium by the mechanism of air being heated up then sent to the material chamber to closely surround and heat up the vaping medium for a user's enjoyment.

3 Claims, 2 Drawing Sheets

DIRECT HEATING VAPORIZER

FIELD AND BACKGROUND OF THE INVENTION

Present invention relates to personal vaporizers where direct heating mechanism is used to heat up tobacco or any desired vaping medium.

Traditional vaping devices heat up the vaping medium mainly in two ways: first, by either heating up the container that holds the vaping medium; second, by energizing a coil (by electricity) to raise the temperature on the coil, which then heats the vaping medium.

The heated up vapor (containing the heated the medium in the vaporizer) is then inhaled by a user. Typically, this is done by an atomizer unit that selectively, and as controlled by a user, heats up the medium in order to produce the vapor. A battery, rechargeable us USB power, is also regularly employed to provide the electric power source. The incorporation of a battery power source is known art in the relevant industry and needs no further discussion herein, nor is the incorporation of the battery power being claimed.

FIG. 1 shows a first traditional way of heating where a container (a bowl, or a cup) receives the heat first, then the heat energy is transferred to the tobacco, or other vaping medium, inside the container.

FIG. 2 shows a second traditional way of heating where a heating coil (or a heating bar, a stick, whatever the actual structure is used) receives the heat first, then the heat energy is transferred to the tobacco, or other vaping medium around the heating coil.

Such traditional ways of heating up the vaping medium have several disadvantages:

1. The time it takes to heat up the vaping medium is long, usually between 10 to 60 seconds. This is because some heat energy is indirectly transferred, aka conducted, from the container or the coil to the tobacco or other vaping medium.
2. The heating efficiency is low, because some heat energy is absorbed by the container or the coil before the heat is sent to the tobacco or other vaping medium.
3. Some vaping medium will be wasted even though a user is not using the vaping device, similar to a lit cigarette's waste during the time when no one is inhaling.

In addition, different construction of the heating mechanism also has issues of uneven heating due to the difference in distance to the heat source, either the heating coil or a heating container. Apparently, vaping medium not directly touching the heating coil or the heating container receives less heat than other medium that is immediately touching the heat source.

The direct heating vaporizer of present invention overcomes the disadvantages via the following improvements.

1. By heating the air, the heating time is shortened, to within 10 seconds. This is faster than the traditional vaping devices' time.
2. By heating the air, the tobacco or other vaping medium receives heat energy in a more evenly fashion and produces better enjoyment for a person using the vaping device.
3. The tobacco or other vaping medium will not be "burned away", thus avoiding the waste similar to a cigarette slowing fuming away even when no one is inhaling or drawing a puff from a lit cigarette.

The direct heating vaporizer, via the temperature sensing and control unit, takes roughly 1 to 3 seconds to heat up the air, which then evenly heats up the vaping medium in the material chamber, achieving higher efficiency than the traditional devices.

The mechanism disclosed herein causes the cool air to be drawn in, then heat up inside the heating chamber, and then sent to the material chamber to closely surround and heat up the vaping medium when a user draws a puff, resulting in better enjoyment as noted herein.

SUMMARY OF THE INVENTION

The direct heating vaporizer of present application primarily consists of a tube inside which a heating chamber connected to a material chamber via a filter unit.

A gap layer is formed between inside wall of the tube and outside wall of the heating chamber. Air is drawn in through the gap layer, then heated up in the heating chamber.

A heating net is located inside the heating chamber and can produce heat to heat up the air inside the heating chamber when activated and controlled by a temperature sensing and control unit.

The temperature sensing and control unit detects the temperature of the air coming in to the heating chamber via the gap layer and controls the heat generated by the heating net, thus achieving the effect of direct heating, instead of the slower and indirect heating either by a coil or by the container placed around the tobacco or other vaping medium.

In essence, the present invention takes advantage of the air path that is the necessary element of all vaporizers and creates the direct heating mechanism, thus avoiding the energy loss due to the heat being absorbed by due to the indirect heat transfer either by the container that holds the medium or by a heating coil that is situated in the medium, further causing uneven heating.

DESCRIPTION OF THE DRAWINGS

The accompanying drawings, which are incorporated in and constitute a part of this specification, illustrate and exemplify the preferred embodiments of the invention. Together with the description, serve to explain the principles of the invention.

A brief description of the drawings is as follows.

DETAILED DESCRIPTION OF THE PREFERRED EMBODIMENT

The direct heating vaporizer of present application primarily consists of a tube 3 with a base 8. A heating chamber 5 is located inside the tube 3 and is adjacent to the base 8.

Figure 1:
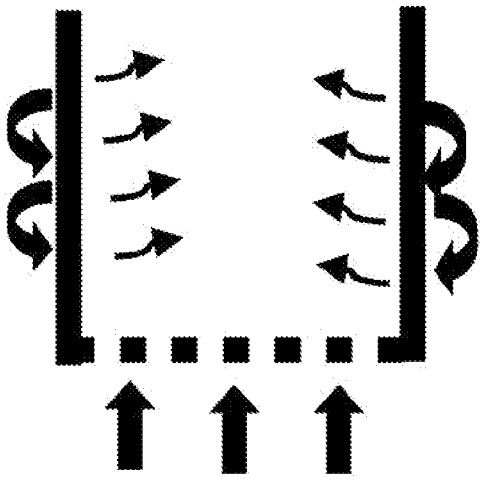
Fig. 1 (PRIOR ART)
FIG. 1 shows the traditional design of heating the vaping medium by the container.
Figure 2:
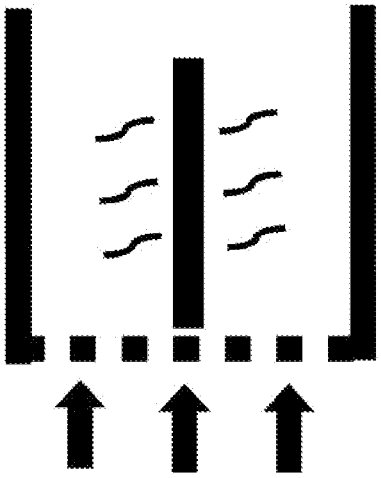
Fig. 2 (PRIOR ART)
FIG. 2 shows the traditional design of heating the vaping medium by a heating coil.
Figure 3:
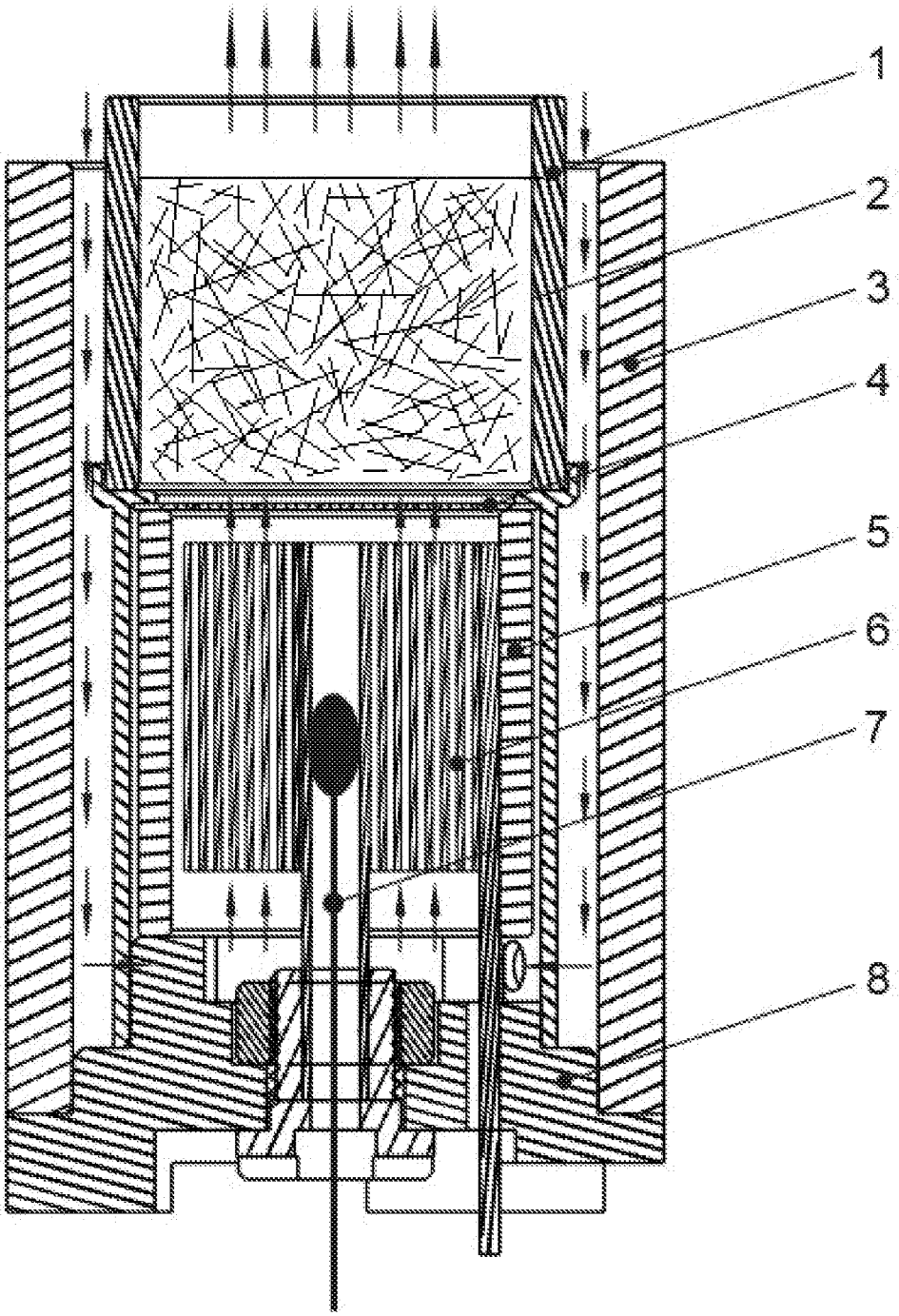
FIG. 3 shows the mechanism of present invention and the elements.

A gap layer is formed between inside wall of the tube 3 and outside wall of the heating chamber 5, as shown in FIG. 3.

A material chamber 1 is connected to the heating chamber 5 by a filter unit 4.

A heating net 6 is located inside the heating chamber 5 and can produce heat when activated and controlled by a temperature sensing and control unit 7.

The temperature sensing and control unit 7 extends out from the base 8, with its sensing probe located inside the space defined by the heating net 6, The temperature sensing and control unit 7 detects the temperature of the air coming in to the heating chamber 6 via the gap layer and controls the heat generated by the heating net 6 to heat the air going to the material chamber 1.

The material chamber 1 can hold tobacco 2, or other materials such as wax or any desired vaporizing medium.

The filter unit 4 is removable for cleaning purpose and can also be replaced if desired.

The direct heating vaporizer, via the temperature sensing and control unit, takes roughly 1 to 3 seconds to heat up the air coming in to the tube 3 and, via the gap layer, goes into the heating chamber 5, which then evenly heats up the vaping medium 2 in the material chamber 1, achieving higher efficiency of heating and less wasting, overcoming the disadvantages of the traditional devices.

In essence, the present invention takes advantage of the air path, from the gap layer where the outside air is drawn in to the heating chamber 5 and then through the material chamber 1, that is the necessary element of all vaporizers and creates the direct heating mechanism, thus avoiding the energy loss due to the heat being absorbed due to the indirect heat transfer either by the container that holds the medium or by a heating coil that is situated in the medium, further causing uneven heating.

Given the shorter heating time needed in the direct heating mechanism disclosed herein, and the reduced waste of the vaping medium, a user will get better enjoyment out of using the direct heating mechanism of present invention.

The disclosure herein gave specific embodiments of the invention, it should be understood that various features and obvious adaptations can be made that are still within the scope of the present invention. The scope of the inventive subject matter is certainly not limited by the particular embodiments described herein, but should be determined only by a reading of the claims presented.

The invention claimed is:

1. A direct heating vaporizer, comprising:

a tube with a base;

a heating chamber inside the tube adjacent to the base, forming a gap layer between inside wall of the tube and outside wall of the heating chamber;

a material chamber connected to the heating chamber by a filter unit;

a heating net located inside the heating chamber; and a temperature sensing and control unit extending out from the base with a sensing probe located inside the space defined by the heating net, wherein the temperature sensing and control unit detects the temperature coming in to the heating chamber via the gap layer and controls the heat generated by the heating net to heat the air going to the material chamber.

2. The direct heating vaporizer of claim 1 wherein the material chamber can hold tobacco, wax or other vaporizing medium in the chamber.

3. The direct heating vaporizer of claim 1 wherein the filter unit is removable and replaceable.

* * * * *